US005556219A

United States Patent [19]

Mason

[11] Patent Number: 5,556,219

[45] Date of Patent: Sep. 17, 1996

[54] CONNECTOR FOR A FRAMEWORK STRUCTURE

[76] Inventor: William R. Mason, 2322 Pine Tree Ct., Kissimmee, Fla. 34744

[21] Appl. No.: 358,824

[22] Filed: Dec. 19, 1994

[51] Int. Cl.[6] ..... F16B 7/22; E04B 1/58

[52] U.S. Cl. ..... 403/176; 403/171; 403/169

[58] Field of Search ..... 403/217, 170, 403/171, 172, 176, 378, 178; 52/648.1, 650.1, DIG. 10, 81.3; 446/124, 126, 128

[56] References Cited

U.S. PATENT DOCUMENTS 4,484,429 11/1984 Stephenson .

FOREIGN PATENT DOCUMENTS 2806764 8/1979 Germany ..... 403/171
2158544 11/1985 United Kingdom ..... 403/172
2159910 12/1985 United Kingdom ..... 403/172

*Primary Examiner*—Anthony Knight
*Attorney, Agent, or Firm*—James H. Beusse

[57] ABSTRACT

A framework connector comprises a main body having a hemispherical surface with a plurality of non-circular projections extending outwardly from the hemispherical surface. Each of the projections have at least three longitudinally extending, circumferentially spaced land areas. Two of the three land areas are relatively closely spaced and define a projection surface therebetween. Another of the land areas is located opposite the projection surface. A post extends vertically outward from the projection surface. Each connector includes an elongate tubular member for connecting one connector to another connector. The tubular member has an inner diameter selected to slidingly engage the land areas of the projection when the member is inserted over a projection. The tubular member has a hole for receiving the post for releaseably coupling the member to the connector.

5 Claims, 1 Drawing Sheet

CONNECTOR FOR A FRAMEWORK STRUCTURE

BACKGROUND OF THE INVENTION

This invention relates to connectors of a type suitable for connecting together elongate members to form a framework structure which may be used, for example, as a display structure or a framework structure.

U.S. Pat. No. 4,484,429 discloses a framework connector having a first group of at least four projections extending outwardly from a main body and equi-angularly spaced about an axis normal to a plane parallel to the direction in which each projection of the first group extends from the main body, and a second group of at least four projections extending outwardly from the main body and being equi-angularly spaced about the axis, the projections of the second group each extending at between 15° and 75°, and preferably at 45° or substantially 45°, to the aforesaid plane.

Preferably each projection is of non-circular cross-section and there is an equal number of projections in the first and second groups. The projections of the second group are angularly staggered by half the angle between adjacent projections of the first group about the axis relative to the projections of the first group.

The main body includes a cylindrical or substantially cylindrical surface portion from which the first group of projections extend and a partial spherical or substantially spherical end portion adjoining the cylindrical portion and from which the second group of projections extend. In the illustrated embodiment, each projection is of triangular or substantially triangular cross-section having a flat or a substantially flat portion provided at the junction between each pair of adjacent sides of each triangular or substantially triangular projection.

In use, elongate tubular members are coupled between connectors to form a framework structure. The tubular members are sized to fit snugly about the projections on the connectors by slipping the open ends of the tubular members onto respective ones of the projections. While U.S. Pat. No. 4,484,429 suggested that the tubular members could be heat welded or adhesively bonded to the projections, it has become generally accepted practice to drill a hole into each of the projections and to form mating holes in each end of the tubular members so that when the tubular members are inserted over the projections, a pin can be inserted through the aligned holes to releaseably couple the elongate member to the connector. While it is desirable to have a releasable connection, the additional manufacturing step of drilling holes in each projection and the additional assembly steps of inserting pins in each connection present a disadvantage to use and cost of the connectors.

SUMMARY OF THE INVENTION

It is an object of the present invention to provide an improved framework connector which overcomes the above and other disadvantages of the prior art.

In one form, the invention is implemented in a framework connector of the type described in U.S. Pat. No. 4,484,429. Each projection of the connector incorporates a post extending vertically from a surface of the substantially flat portion of each projection. Each post extends at least a distance sufficient to project through a wall of an elongate member positioned on the projections and has a diameter allowing the post to fit into one of the pre-formed holes in the member. In a preferred form, an upper surface of the post is tapered to facilitate sliding of the elongate member over the post and projection. In use, the elongate member can be squeezed or compressed slightly to allow the member to be slipped over the projection and post since such compression will tend to deform the end of the member into an oval shape. The elasticity of the member causes it to resume its circular shape after assembly so that the post projects into the associated hole in the member thus locking the member to the projection.

BRIEF DESCRIPTION OF THE DRAWINGS

The invention will now be more particularly described with reference to the accompanying drawings wherein.

DETAILED DESCRIPTION OF THE INVENTION

Figure 1:
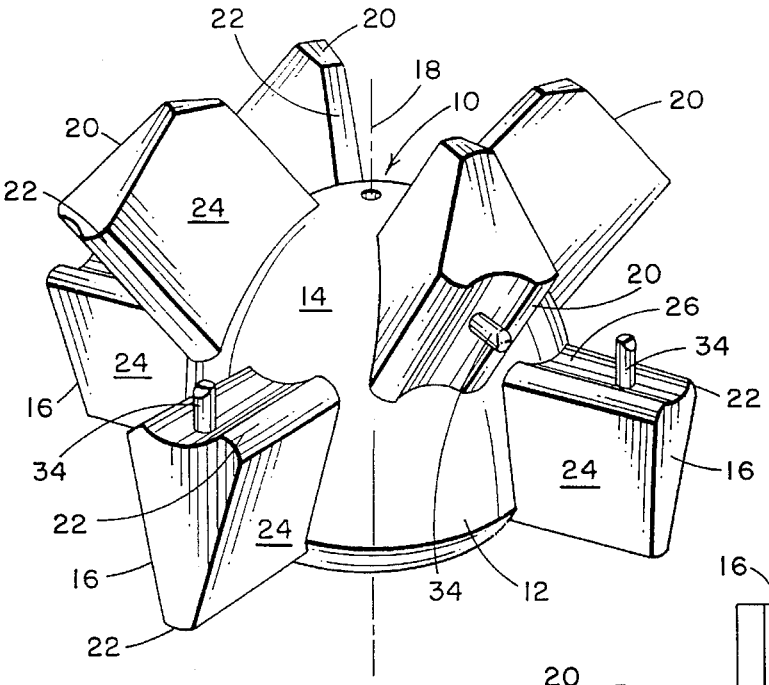
FIG. 1 is a perspective view of one embodiment of a connector according to the invention.

Referring to FIGS. 1 through 4 of the drawings, the connector shown therein includes a body part 10 having a cylindrical surface portion 12 and a part-spherical end portion 14 which adjoins the cylindrical surface portion 12 forming a hemispherical surface. The other end portion of the body part will be referred to later. A first group of four projections extend outwardly from the cylindrical surface portion 12 and are equi-angularly spaced about an axis 18 of the cylindrical surface portion 12. The projections 16 extend in a common plane which is normal to the axis 18. A second group of four projections 20 extend outwardly from the part-spherical end portion 14 of the body part 10. These projections 20 are also equi-angularly spaced about the axis 18 but are angularly staggered by 45° about this axis relative to the projections 16. Also the projections 20 extend at an angle of between 15° and 75°, and preferably at 45°, to the common plane.

Each projection 16 or 20 is of non-circular cross-section and ideally is of substantially triangular cross-section as shown. Each projection 16 or 20 has a land 22 at the junction between each pair of sides. Each land 22 is slightly convex with a radius corresponding to the inside diameter of an elongate member 32 (see FIG. 4).

Each projection has two sides 24 of equal length and a side 26 of shorter length. Each side 26 has a concave recess.

The other end of the connector is provided with an axially inwardly extending annular groove 28 (see FIG. 2) which may receive the end of a tube serving as a vertical support column. As shown, this other end of the connector is also provided with a plurality of integral ribs 30 at the bottom of groove or channel 28, which ribs underlie surface portion 12. During forming of the connector from a non-flexible plastic, it has been found that the surface 12 may deform. The ribs 30 provide a support for the surface during casting and prevent such deformation.

Figure 3:
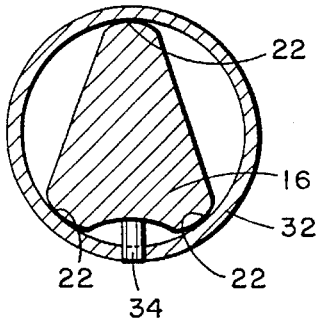
FIG. 3 is a cross-sectional view showing a tube mounted on a projection of the connector of FIGS. 1 and 2.
Figure 2:
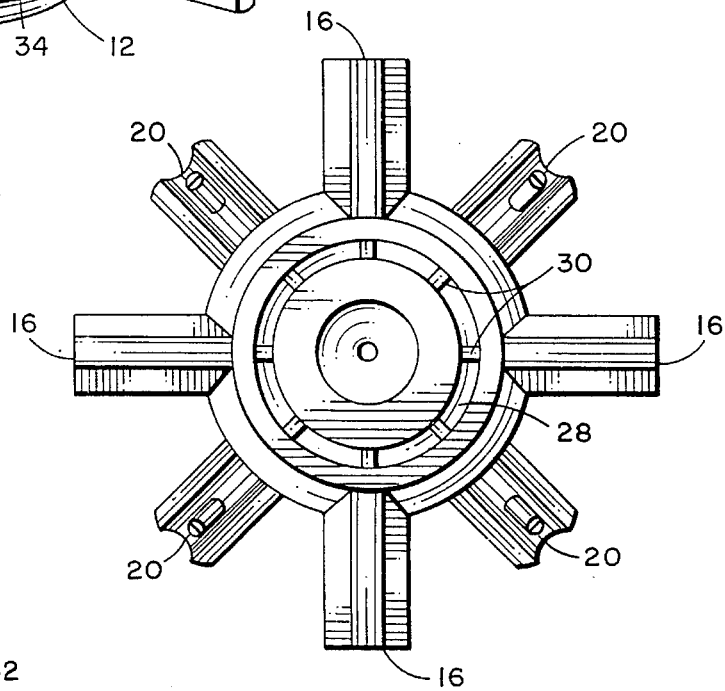
FIG. 2 is an end view of the connector of FIG. 1.
Figure 4:
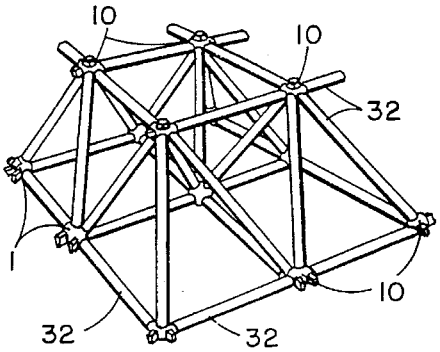
FIG. 4 is a schematic view showing a plurality of elongate members connected together by connectors of FIGS. 1 through 3 to form a space frame.
Figure 5:
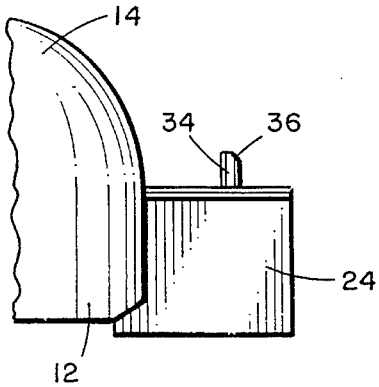
FIG. 5 is a partial side view of the connector of FIG. 1 illustrating the configuration of the retaining posts.

It can be seen that each projection 16 and 20 incorporates a post 34 which projects vertically outward from surfaces or sides 26. As shown in FIG. 3, each post projects into a mating hole in an elongate member 32. It will also be noted that the member 32 fits about projections 16, 20 without significant distortion, i.e., the member 32 is circular in cross-section rather than ovally deformed. Accordingly, the member 32 can be slipped over a projection 16, 20 by squeezing or compressing the end of the member 32 during assembly and then allowing the elasticity of the member to cause it to resume its circular shape and lock into position over post 34. Preferably, the posts 34 are formed with a tapered upper surface 36 (see FIG. 5) to facilitate sliding member 32 over the post and projection.

A plurality of such connectors can be used to connect together elongate members in the form of deformable plastics cylindrical tubes 32 (see FIG. 4) to form a space frame which may be used, for example, as a display stand. In order to locate a tube 32 on a projection 16 or 20, an end of the tube 32 is deformed, by hand pressure, pushed over the projection and then released. The inner wall of the tube is engaged by each of the three lands 22 of the projection as an interference fit (see FIG. 3).

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A framework connector comprising:

a main body having a hemispherical surface;

a plurality of solid, non-circular projections extending outwardly from said hemispherical surface of said main body, each of said projections having at least three longitudinally extending, circumferentially spaced land areas, two of said three land areas being relatively closely spaced and defining a surface therebetween, another of said land areas being located opposite said surface; and at least one fixed, non-compressible post extending generally normal from each said surface of said projections.

2. The framework connector of claim 1 wherein said post includes a tapered top surface.

3. The framework connector of claim 1 and including an elongate tubular member for connecting one connector to another connector, said tubular member having an inner diameter selected to slidingly engage said land areas when said member is inserted over one of said projections, said tubular member having a hole for receiving said post for releaseably coupling said member to said connector.

4. The framework connector of claim 1 and including:

an annular groove formed in said main body on a side opposite said hemispherical surface, said groove being adapted for receiving an end of a tubular member for coupling said main body to said tubular member; and a plurality of circumferentially spaced ribs formed in said groove integrally with said hemispherical surface for preventing collapse of said hemispherical surface during molding.

5. A method for releasably coupling a plurality of generally cylindrical structural tubes to a framework connector, the connector comprising a main body having a plurality of non-circular projections extending outwardly of the body, each of the projections having a generally triangularly shaped cross-section with corners of the triangular shape being truncated to form land areas adapted for contacting an inner surface of a tube when a tube is positioned on one of the projections, two of the land areas being relatively closely spaced and defining a surface therebetween, at least one post extending from and generally normal to the surface, each of the tubes having at least one aperture through a wall thereof for passage of the post when the tube is in an assembled position on the associated projection, the method comprising the steps of:

rotating one of the tubes about a lengthwise axis thereof to align the aperture in the one of the tubes with the post on one of the projections;

compressing an end of the one of the tubes into a generally oval cross-section having a shape to slide onto the one of the projections;

sliding the end of the one of the tubes onto the one of the projections until the aperture in the one of the tubes is positioned approximately over the post on the one of the projections; and releasing the compression of the end of the one of the tubes such that the tube returns to its normal cylindrical shape and the post passes through the aperture to retain the tube on the one of the projections.

* * * * *